US005212886A

United States Patent [19]

Tasaki

[11] Patent Number: 5,212,886

[45] Date of Patent: May 25, 1993

[54] CHAIN SAW

[75] Inventor: Takanobu Tasaki, Tokyo, Japan

[73] Assignee: Kioritz Corporation, Tokyo, Japan

[21] Appl. No.: 821,786

[22] Filed: Jan. 16, 1992

[30] Foreign Application Priority Data

Jan. 23, 1991 [JP] Japan ..... 3-6525[U]

[51] Int. Cl.[5] ..... B27B 17/00

[52] U.S. Cl. ..... 30/381; 30/382

[58] Field of Search ..... 30/382, 381, 383; 74/104, 107; 123/400

[56] References Cited

U.S. PATENT DOCUMENTS

| | | | |
|---|---|---|---|
| 3,370,475 | 2/1968 | Hunter et al. | 74/104 |
| 4,144,770 | 3/1979 | Landen | 74/47 |
| 4,335,514 | 6/1982 | Overy et al. | 30/382 |
| 4,406,066 | 9/1983 | Itzrodt | 30/382 |
| 4,765,282 | 8/1988 | Nagashima | 123/41.7 |
| 4,785,539 | 11/1988 | Nagashima | 30/382 |
| 4,798,185 | 1/1989 | Driggers | 123/400 |
| 4,896,425 | 1/1990 | Henriksson | 30/381 |
| 5,029,393 | 7/1991 | Nagashima et al. | 30/383 |
| 5,065,476 | 11/1991 | Dohse et al. | 30/383 |

FOREIGN PATENT DOCUMENTS

| | | | |
|---|---|---|---|
| 2098272 | 11/1982 | United Kingdom | 30/383 |

*Primary Examiner*—Frank T. Yost
*Assistant Examiner*—Hwei-Siu Payer
*Attorney, Agent, or Firm*—Bauer & Schaffer

[57] ABSTRACT

A chain saw in which a body having an engine, carburetor and throttle rod and a handle frame on which is located a fitting mounting a trigger are connected with each other though vibration damping members. The trigger is provided with a plurality of bends between a contact part and a finger grip so as to have a predetermined spring effect. The contact part is arranged in opposition to the end of the throttle rod and spaced from it. As contact part abuts the rod and the chain saw is flex the resilient spring effect from the bends reduces the vibration transmitted to the handle.

3 Claims, 3 Drawing Sheets

CHAIN SAW

FIELD OF THE INVENTION

This invention relates to a chain saw having an improved throttle trigger.

BACKGROUND OF THE INVENTION

It has been known to provide a chain saw driven by an internal combustion engine mounted in a housing body having a throttle valve, and a throttle rod, actuated by throttle trigger mounted in a fitting in the rear handle of the chain saw. The body and the fitting are connected to each other through a vibration damping member made of rubber or the like, so that when a force is applied to move the throttle trigger a part of the throttle trigger will contact and move the throttle rod to open the throttle valve.

In a chain saw of this type, as the body and the fitting for the throttle trigger (usually the rear handle) are connected to each other through the vibration damping members, vibration will be prevented from being transmitted to the handle. Also, although vibration damping members are used, the throttle rod and the throttle trigger are separated from each other in the idling state of the engine. This prevents deformation of the vibration damping members even during idling of the engine.

However, even in this kind of chain saw, when a force is applied to the throttle trigger sufficient to keep the throttle valve fully open and the saw chain guide bar strongly pressed against the workpiece the vibration damping members are so deformed so as to narrow the clearance between the body and the throttle trigger fitting. As a result, the throttle rod tends to be moved in the reverse direction and, unless measures are taken, an excessive force will be applied to the finger of the worker trying to hold the throttle trigger, so that the worker requires great strength to hold the throttle trigger. Also, vibration will be transmitted to the finger without being effectively damped.

Therefore, in the conventional chain saw, in order to reduce the counter force, applied to the finger of the worker, an elastic member such as rubber, is used as the contact with the throttle rod.

However, even though the elastic member is provided at the point of contact between the throttle trigger and the throttle rod, the force and vibration applied to the finger of the worker is not sufficiently damped and the disadvantage noted above still remains during operation of the throttle trigger.

SUMMARY AND OBJECT OF THE INVENTION

The present invention is made to overcome the above mentioned disadvantage and has it as an object the provision of a chain saw wherein, even when a force is applied to the throttle trigger to keep the valve fully open and the chain saw is strongly pressed against the work piece the counter force and vibration applied to the finger of the worker trying to hold the throttle trigger is significantly reduced and an excessive strength is not required to hold the throttle trigger.

According to the present invention a chain saw is provided wherein a throttle rod, operatively connected to a throttle valve is movably fitted to the body of the chain saw. The throttle trigger is movably fitted to a fitting on the rear handle and the body and the throttle trigger fitting are connected to each other through a vibration damping member so that, when a force is applied to the throttle trigger the contact on the throttle trigger will move the throttle rod with respect to the body to open the throttle valve but will remain spaced therefrom at other times. The throttle trigger is provided with a plurality of bends between the contact portion and the finger operated portion as to provide a predetermined spring effect, integrally formed in the trigger.

According to the present invention, as the throttle trigger is provided with a plurality of bends between its contact portion and operated portion, the predetermined spring effect can be created without using any additional parts.

Therefore, even when the throttle trigger is operated to keep the throttle valve fully open and the body is strongly pressed against the workpiece the above mentioned spring effect obviates the need for any excessive force and the counter vibration fed back to the fingers of the worker is well damped.

BRIEF DESCRIPTION OF THE DRAWINGS

FIG. 3 is a view similar to FIG. 2. showing the chain saw A in use with its guide bar strongly pressed against a wood or the like.

DETAILED DESCRIPTION OF THE PREFERRED EMBODIMENT

Figure 1:
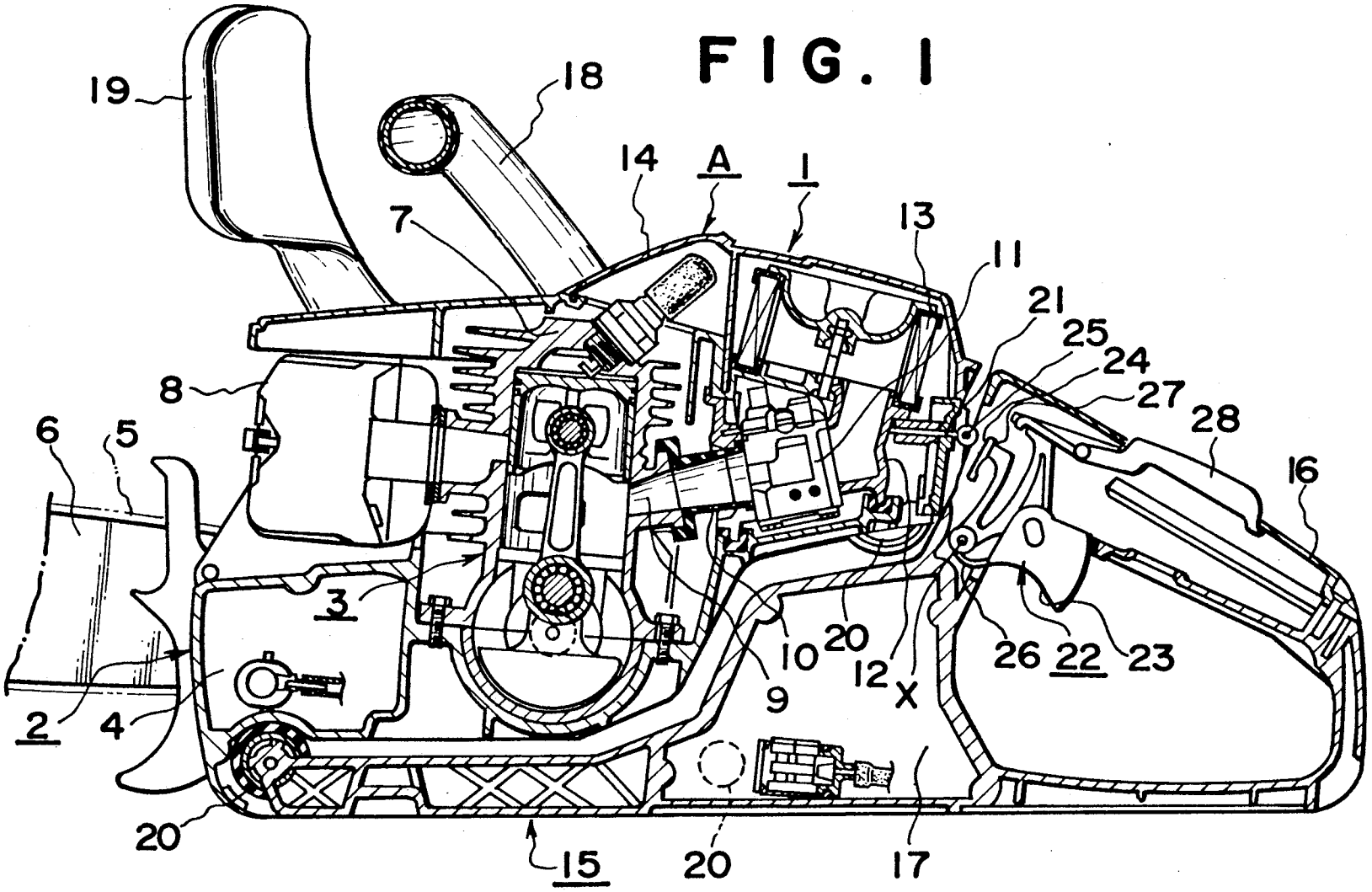
FIG. 1 is a longitudinally sectioned side view showing a chain saw A to which an embodiment of the present invention is applied in an idling state.

The reference numeral 1 represents a body comprising a base 2 molded integrally of a magnesium alloy die-casting or the like, housing a small air-cooled two-cycle gasoline engine 3 which is the prime mover, an oil tank 4 molded integrally in the front part of the base 2 and a lubricating oil pump for a saw chain 5. A chain guide bar 6 is fitted to a seat molded integrally on the right side of the base 2, a muffler 8 is attached to the engine cylinder 7, and a throttle valve such as a diaphragm carburetor 11 is connected to the suction port 9 of the cylinder 7 through a suction pipe 10 made of rubber. An air suction elbow 12, an air cleaner 13 and an upper surface cover 14 are also provided.

A handle frame 15 separable from the body 1 and made from a strengthened plastic or the like is provided to accommodate a rear handle 16 and fuel tank 17 molded integrally within the frame 15. Incidentally, in the embodiment shown in the drawings, the handle frame 15 also comprises the fitting or mounting for a throttle trigger. A front handle 18 is secured to the handle frame 15 and is protected by a front handle guard 19.

The body 1 and the handle frame 15 (which is the throttle trigger fitting) are connected to each other by vibration damping members 20 arranged horizontally in the right and left edges of the body 1. That is to say, as shown in FIG. 1, the front lower edge and rear edge of the base 2 are connected to the handle frame 15 by the above mentioned vibration damping members 20. It is further connected in the same manner in the front lower and upper positions of the fuel tank 17.

A throttle rod 21 is operatively connected to a throttle valve of the carburetor 11 to slide in the front and rear directions relative to the above mentioned body 1.

A forked lever-like throttle trigger 22 rocks in a vertical direction and is pivotally fitted to the handle frame 15 so that when a force is applied to the finger grip 23 the throttle trigger 22 causes a contact part 24 to bear against a roller 25 mounted at the rear end of the throttle rod 21, moving the throttle rod 21 forward to open the throttle valve.

Figure 2:
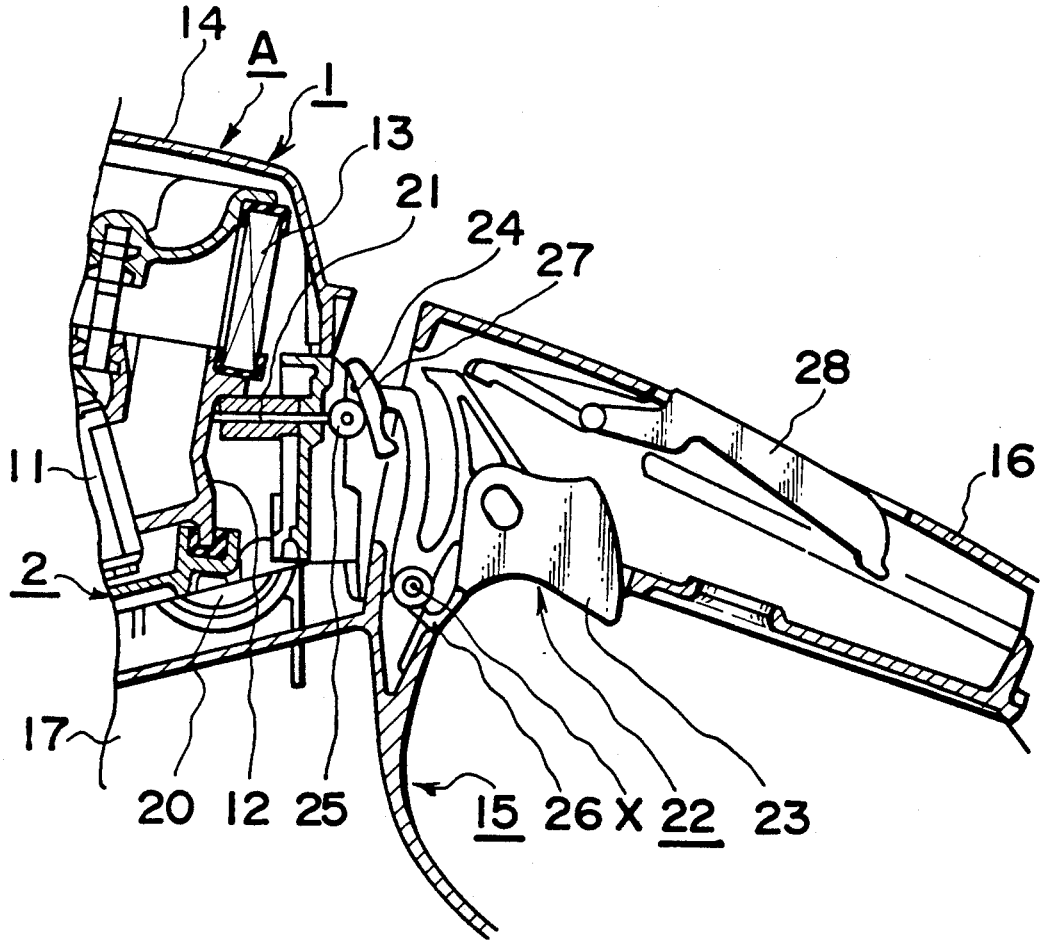
FIG. 2 is an enlarged longitudinally section side view of the trigger area showing the chain saw A in normal use.
Figure 3:
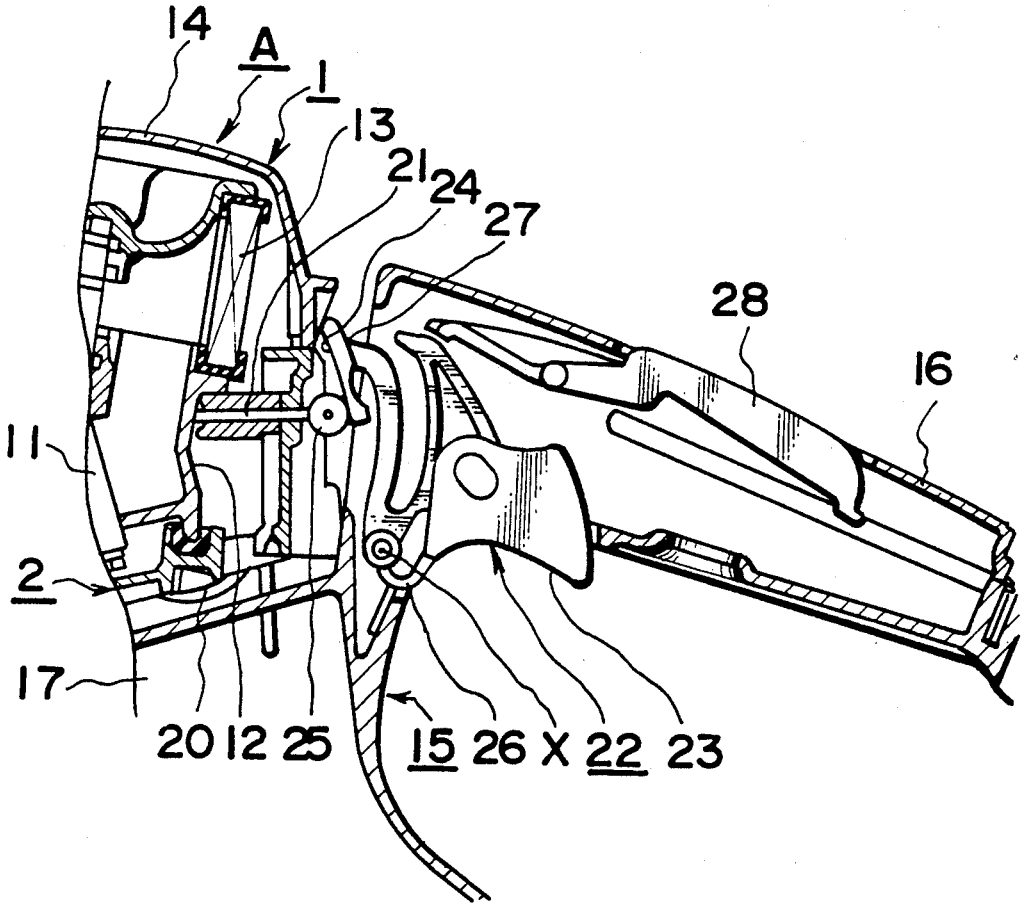

That is to say, the throttle rod 21 is slidable from a normal position, extending outwardly of the rear of the body 1, inwardly from right to left as seen in FIGS. 1 to 3 so that the throttle valve will be operatively opened and closed. The throttle rod 21 is biased rightward by a throttle valve return spring and its rightward movement is restricted in the position shown in FIG. 1.

The throttle trigger 22 is integrally molded of a synthetic resin having a selected elasticity and is mounted to pivot around an axis X (extending in the direction vertical to the paper surface of the figures) at the front of the rear handle 16. The throttle trigger 2 is biased clockwise by a spring and its clockwise rotation is restricted to the position shown in FIG. 1, in which the contact part 24 of the throttle trigger 22 will be opposed to and spaced, with a proper clearance, from a roller 25 secured at the rear end of the throttle rod 21 thus preventing the transmission of vibration between them. When a force is applied to the finger grip 23 to rotate the throttle trigger 22 counter-clockwise, the contact part 24 engages the roller 25 moving the throttle rod 21 leftward.

The throttle trigger 22 is provided with a plurality of bends 26 and 27 located between the contact 24 and the finger grip 23 so as to have a predetermined spring effect. In the embodiment shown in the drawings, the bends 26 and 27 are two in number.

A safety device 28 is provided to lock the throttle trigger 22 in an idling position.

The chain saw A according to the present invention will be stored in a state as shown in FIG. 1 when not being used or when idling, that is, when the throttle trigger 22 is not being operated and when the guide bar 6 is not pressed against a work piece such as wood or the like.

The chain saw A will be in the state shown in FIG. 2 when it is being normally used, i.e., a force is applied to the finger grip 23 where the throttle valve is fully opened and the saw chain 5 is operable. The guide bar 6 can be pressed against the workpiece or the like with minimal force to cut it. In such case, the relative positions of the body 1 and the handle frame 15, on which the throttle trigger is mounted will be substantially the same as in the case of FIG. 1.

In FIG. 3 the chain saw A is illustrated when it assumes a condition as where it is pressed strongly against the workpiece; that is when a force is applied to the finger grip 23 so as to keep the throttle valve fully open and the rear handle 16 and front handle 18 are securely held by the user to strongly press against the workpiece. In such case the vibration damping members 20 will be deformed and therefore the clearance between the body 1 and the handle frame 15 is narrower than in the case of FIG. 1 and FIG. 2. Since the roller 25 at the rear end of the throttle rod 21 tends to move rightward, any large force and vibration should tend to be applied to the finger grip and therefore to the worker trying to hold the throttle trigger 22. However, as the throttle trigger 22 is provided with the plurality of yieldable bends 26 and 27 between its contact part 24 and the finger grip 23, the throttle trigger 22 will have a predetermined sufficient spring effect by which the force and vibration will be significantly reduced. Therefore the user will not be required to hold the throttle trigger 22 with any excessive force and no disadvantage will be caused by the transmission of the vibration.

As explained in detail in the above, according to the present invention, there are obtained such effects that, even in case a force is applied to the operating parts of the throttle trigger to keep the throttle valve fully open or the body is strongly pressed against the wood or the like to cut it, a large force will not be required to hold the throttle trigger.

I claim:

1. A chain saw comprising a body housing an internal combustion engine, a carburetor and a throttle rod for controlling the carburetor, a handle frame having a fitting for mounting a trigger mechanism for actuating said throttle rod, and vibration damping means for resiliently connecting said body and said fitting, said trigger mechanism comprising a pivotal finger grip, a contact part for abutting an end of the throttle rod on pivoting of said finger grip and a plurality of yieldable bends arranged between said contact part and said finger grip so as to provide a predetermined spring bias therebetween.

2. The chain saw according to claim 1 wherein the end of said throttle rod is provided with a roller.

3. The chain saw according to claim 2, wherein said trigger mechanism is arranged so that the contact part is located in opposition to and spaced from the roller when the finger grip is at a rest, non-operative position.

* * * * *